United States Patent [19]

Dezsi

[11] 4,382,601

[45] May 10, 1983

[54] CYLINDRICAL LOGICAL TOY

[75] Inventor: Istvan Dezsi, Szolnok, Hungary

[73] Assignee: Konsumex Külkereskedelmi Vallalat, Budapest, Hungary

[21] Appl. No.: 235,527

[22] Filed: Feb. 18, 1981

[30] Foreign Application Priority Data

Mar. 3, 1980 [HU] Hungary ..... 484

[51] Int. Cl.[3] ..... A63F 9/08

[52] U.S. Cl. ..... 273/153 S

[58] Field of Search ..... 273/153 S, 155; 40/503, 40/506; 434/174, 206, 402

[56] References Cited

U.S. PATENT DOCUMENTS

| | | | |
|---|---|---|---|
| 785,665 | 3/1905 | Coe | 273/153 S |
| 1,703,159 | 2/1929 | Monheim | 273/155 |
| 3,239,951 | 3/1966 | Benson | 434/174 |
| 4,208,052 | 6/1980 | Snow | 273/153 S X |

*Primary Examiner*—Anton O. Oechsle

*Attorney, Agent, or Firm*—Gabriel P. Katona

[57] ABSTRACT

The invention relates to a cylindrical logical toy to be used individually or for competition in a group. It contains elements provided with distinguishing marks arranged in nests formed on the cylindrical mantle, in the rings of the cylinder. Arrangement of the elements enables the player to rearrange the elements with identical mark according to a predetermined variation. The elements can be moved concentrically and with a certain limitation along the cylindrical mantle.

4 Claims, 2 Drawing Figures

CYLINDRICAL LOGICAL TOY

BACKGROUND

The invention relates to a cylindrical logical toy having turnable and displacable elements, the use of which requires the combinative ability of the human mind to operate.

Recently numerous logical toys have become known but some of them such as the "Toy with Balls" described in Soviet Pat. No. 44 869—is very simple for the players, while some others such as the "Spatial Logical Toy" described in Hungarian Pat. No. 170 062, are very complicated both structurally and in respect of the solution of the problem set by the toy.

BRIEF DESCRIPTION OF THE INVENTION

An object of this invention is to provide a logical toy of simple structure that gives rewarding experiences equally to children and adults due to the set problems of average level and by their relatively simple solution.

The invention consists in a cylindrical logical toy having turnable and displacable elements; the essence of the invention is that the cylinder is formed by rings provided with nests with the elements arranged in said nests. The number of rings suitable for receiving the ordered elements is identical with the number of the nests in said elements. The number of the applied elements is equal to the squared number expressing said two identical quantities. The distinguishing marks of the rings are as many as the number of the rings. At one end of the rings an additional ring is arranged and provided with at least one nest and all rings are turnable around their common shaft, and the elements can be pushed over into a vacant nest of the adjacent rings.

According to a preferred feature of the invention the toy comprises marks suitable for the identification of the elements in order to determine the rearrangement problem of the elements to be solved.

In the cylindrical logical toy according to the invention, the elements which are distinguished by color and/or shape can be moved with the fingers around the cylindrical mantle and in the direction of the generatrix of this mantle, in order to arrive at a predetermined variation of the elements. The movable elements are placed into the cylindrical mantle along rings preventing them from falling out during their appropriate movement and preventing them also of changing their position by their deadweight. The number of the elements is the square of a whole number greater than two.

The great advantage of the toy according to the invention resides in its simple construction. Therefore it can be easily economically manufactured with simple tools.

Other advantages are apparent, thus, the toy according to the invention, despite its simple construction, is suitable for the solution of extremely versatile problems, it ensures pleasant pastime for a wide circle of people and it also facilitates the safe micro-motions of the fingers for children. The toy according to the invention may be used individually as an entertaining pastime during travels, waiting, etc., and it can be used also in the form of competition, when it is aimed at comparing the inventiveness and manual dexterity of the participants. Due to its assembly, no preparation is necessary prior to commencement of the game, and in case of suitably chosen dimensions it is easy to handle.

BRIEF DESCRIPTION OF THE DRAWINGS

A preferred embodiment of the invention is described in the accompanying drawings, wherein.

DETAILED DESCRIPTION

Figure 1:
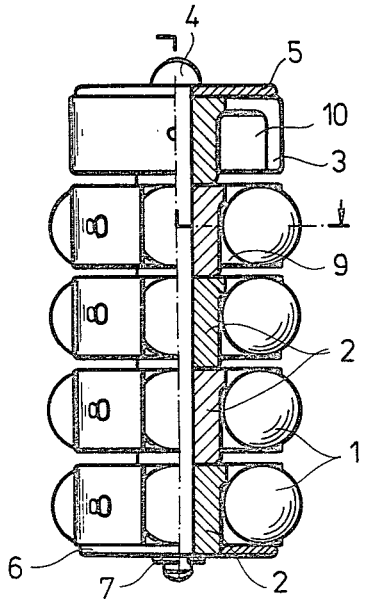
FIG. 1 is a part elevation, part vertical section of the cylindrical logical toy according to the invention.
Figure 2:
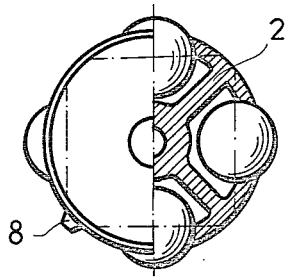
FIG. 2 is a top plan view of the toy shown in FIG. 1.

The cylindrical logical toy illustrated in FIGS. 1 and 2 is formed by rings provided by nests in which the elements 1 are arranged. The number of the elements 1 is, in the illustrated embodiment, $4\times4=16$. The elements 1 are of a ball-shape. In each of the four lower rings 2 are four nests 9 which are open at the top and the bottom and spaced in a quarter circle from one another. In the upper ring 3 at least one nest 10 is formed identical to the others. The sixteen balls (elements) 1 are of four different colors, with four balls 1 of each color. The balls 1 are arranged in the initial position according to the drawing as to have the balls 1 of the same color in the same ring. The rings 2 provided with balls 1 and the ring 3 without ball 1 are assembled with a shaft 4 and a ring retainer 7 with the insertion of an upper end plate 5 and a lower end plate 6. The rings 2 and 3 of the cylinder are freely turnable around the shaft 4. The ball 1 below or above which a vacant ball nest 9 or 10 is in another ring 2 or 3, can be pushed over in said vacant nest by the pressure of the finger.

The toy includes four problem-setting marks in the form of marks 8 of the same colors as that of the balls 1, which can be put, according to the set problem, into holes provided in the rings 2 according to each ring, or into corresponding holes of the ring 3 according to each column.

The toy according to the invention is used as follows:

The arrangement to be realized by the balls 1 is determined with the problem-setting marks 8. Thus two basic variations can be given:

variation according to columns, variation according to rings.

At the column variation the problem-setting marks 8 are placed into the holes of the ring 3. In this case the balls 1 of the same color are to be arranged in the same column as to have the color sequence of the columns conforming to the sequence of the marks 8.

At the ring variation the problem-setting marks 8 are placed into the hole of each ring 2. In this case the balls of the same color as that of the problem-setting marks 8 have to be pushed into the given ring 2.

The problem is the simplest when with the basic ring variation the balls of two adjacent rings 2 below the ring 3 have to be exchanged. This is carried out by first exchanging the problem-setting marks 8 at the given ring 2 and then by turning the balls 1 a minimum of twelve-times in the direction of the generatrix of the cylindrical mantle and by turning the rings 3 and 2 in a quarter-circle a minimum of eight-times, the problem can be solved.

Complexity of the problem is increased:

when exchanging the balls of the two rings 2, no ring 2 is adjacent to ring 3, the two rings 2 are not adjacent, when the balls of three rings 2 have to be exchanged, when the balls of all four rings 2 have to be transferred to another ring 2.

The same kind of problems can be given for the balls 1 arranged in columns.

Logically even more complicated is the problem, when the balls 1 are arranged irregularly, or in different formation and have to be rearranged to ring or column-type formation.

The most complicated is the game, when the balls 1 of the same color have different shades and the requirement is to arrange the balls 1 according to the darkening or lightening shades.

I claim:

1. A cylindrical logical toy comprising: a plurality of superposed first rings having the form of a cylinder, wherein each ring has a plurality of nests equal in number to the number of rings and wherein each nest is configured to receive a spherical toy element therein for vertical displacement from one ring to the other; a plurality of toy elements equal in number to the square of the number of rings, the toy elements disposed in said nests; an additional ring disposed at one end of the cylinder and having a single nest therein configured to receive a toy element from the adjacent ring; and means mounting the rings for maintaining same in the cylindrical configuration and for permitting rotation of each ring about the longitudinal axis of the cylinder with respect to the remaining rings.

2. The toy according to claim 1, further comprising marking means disposed on each first ring for indicating the desired form for the rearrangement of the toy elements in the nests of the first rings.

3. A logical toy comprising: a plurality of superposed rings forming a rotationally symmetrical configuration wherein each ring has a plurality of nests equal in number to the number of rings and wherein each nest is configured to receive a spherical toy element therein for vertical displacement from one ring to the other; a plurality of toy elements equal in number to the square of the number of rings, the toy elements disposed in said nests; means forming an additional location for receiving a single toy element from an adjacent nest; and means mounting the rings for maintaining same in the rotationally symmetrical configuration and for permitting rotation of each ring about the longitudinal axis with respect to the remaining rings.

4. The toy according to claim 3, further comprising marking means disposed on each ring for indicating the desired form for the rearrangement of the toy elements in the nests thereof.

* * * * *